US005444877A

United States Patent [19]

Kumarasurier

[11] Patent Number: 5,444,877

[45] Date of Patent: Aug. 29, 1995

[54] FOOT ACTUATED DOUBLE ACTING LEVER FOR LIFTING A TOILET SEAT

[76] Inventor: Jey Kumarasurier, 39113 Sundale Dr., Fremont, Calif. 94538

[21] Appl. No.: 274,208

[22] Filed: Jul. 12, 1994

Related U.S. Application Data

[63] Continuation-in-part of Ser. No. 28,251, Mar. 9, 1993, abandoned.

[51] Int. Cl.[6] ..... A47K 13/10

[52] U.S. Cl. ..... 4/246.1; 4/246.3; 49/263; 49/342; 16/374

[58] Field of Search ..... 4/246.1, 246.3, 246.4, 4/240, 241; 220/263, 264; 49/263, 341, 342; 74/98; 475/318, 323, 324; 192/7, 8 R, 92; 16/233, 324, 326, 330, 331, 354, 374 X

[56] References Cited

U.S. PATENT DOCUMENTS

| | | | |
|---|---|---|---|
| 574,339 | 12/1896 | Moore | 4/240 |
| 1,033,502 | 7/1912 | Wheeler | 49/263 |
| 1,222,212 | 4/1917 | Jordan | 220/263 |
| 1,529,656 | 3/1925 | Kornhauser | 4/241 |
| 2,954,565 | 10/1960 | Miller | 4/246.3 |
| 2,986,745 | 6/1961 | Melzassard | 4/246.2 |
| 4,951,324 | 8/1990 | Lirette | 4/251 |
| 4,975,988 | 12/1990 | Won | 4/246.3 |
| 4,984,665 | 1/1991 | Allis | 192/7 |
| 5,103,506 | 4/1992 | Munford et al. | 4/251 |
| 5,339,468 | 8/1994 | Lin | 4/246.5 |

FOREIGN PATENT DOCUMENTS

| | | | |
|---|---|---|---|
| 2238803 | 6/1991 | United Kingdom | 4/246.1 |

*Primary Examiner*—Henry J. Recla
*Assistant Examiner*—Gregory M. Vidovich
*Attorney, Agent, or Firm*—Robert Samuel Smith

[57] ABSTRACT

A foot operated double acting lever for rotating a lid hinged to a base from a first position to a second position such as lifting the seat of a toilet bowl without touching the seat with the hands wherein the lid (or seat) is locked in the second position when the pedal is not depressed thereby maintaining the seat in its second position and is unlocked by depressing the pedal a second time and allowing the lid to rotate back to its first position at a speed that is under control of the foot on the pedal. The device includes a rotating housing coupled to one end of the lever (opposite the end with the pedal) that is coupled to a drive gear that turns a hinge gear mounted to rotate on the same axis as the lid. In order that the lid be locked in the second position, a lock catch engages the drive gear and a fixed slot thereby locking the drive gear. When the pedal is depressed, the lock catch is withdrawn permitting the drive gear to rotate thereby allowing the lid to rotate on its hinge back to its first position.

15 Claims, 14 Drawing Sheets

FIG. 10A
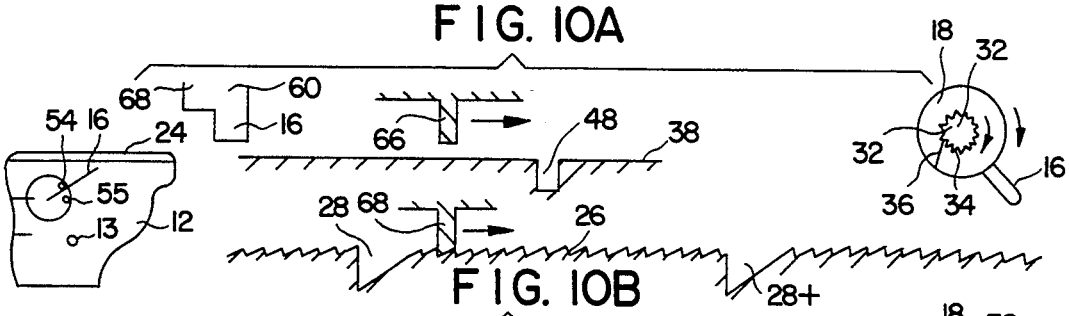
FIG. 10B
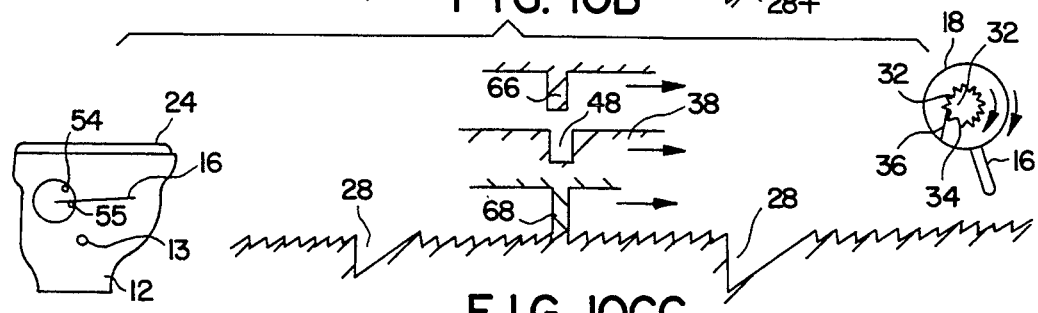
FIG. 10C
FIG. 10CC
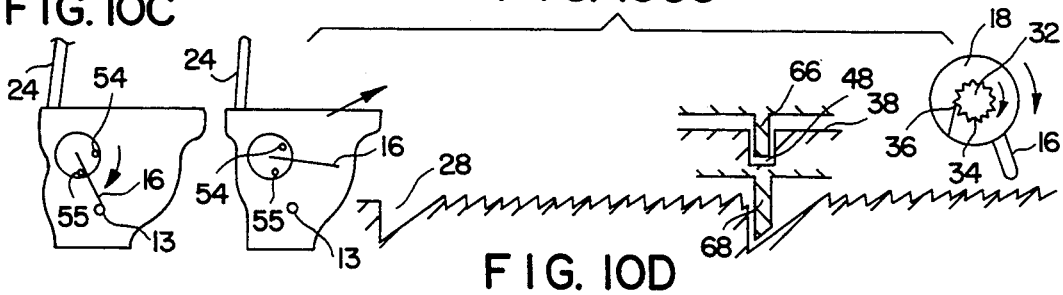
FIG. 10D
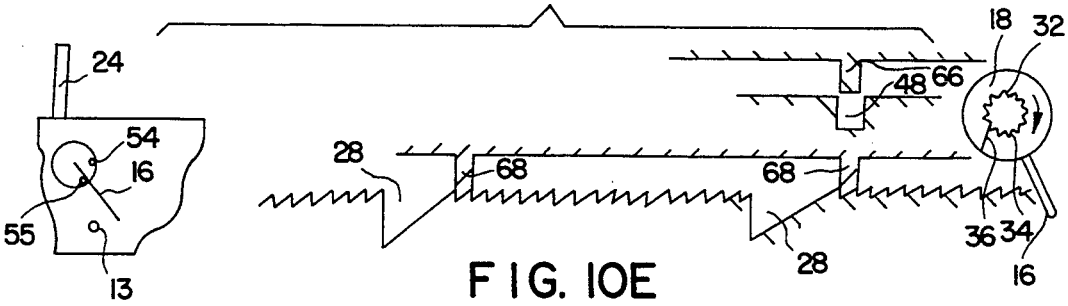
FIG. 10E
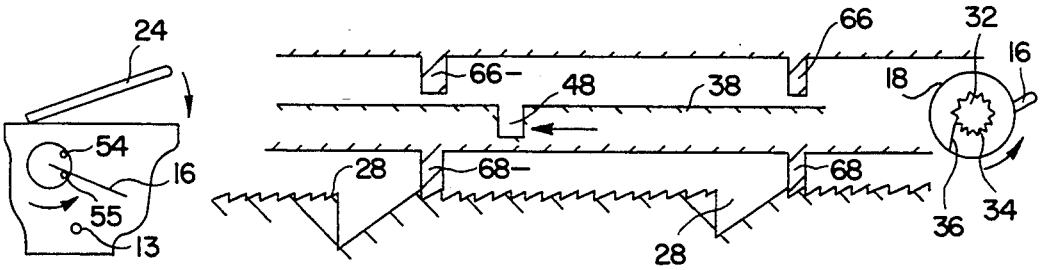

FOOT ACTUATED DOUBLE ACTING LEVER FOR LIFTING A TOILET SEAT

This is a continuation-on-part of copending application Ser. No. 08/028,251 filed on Mar. 9, 1993 which is now abandoned.

BACKGROUND

1. Field of the Invention

This invention relates to foot operated levers such as are to be used for opening hinged members such as support doors or lids or for lifting toilet seats and particularly to a lever that is operated with the foot wherein successive depressions of a single pedal both opens and closes the hinge.

2. Prior Art and Information Disclosure

A number of situations exist where it is desirable to open a hinge supporting a door or lid without using the hands. For example, members of the public using a public toilet often refrain from touching the toilet seat in a public restroom thereby neglect raising the seat. This leads to unsanitary use of the toilet.

Another situation is where a user wishes to store or retrieve heavy articles into or from a container and he would prefer opening or closing the lid without laying the article down.

For these situations, it is advantageous to have a foot operated means to open the lid (or toilet seat). A number of devices have been disclosed in the patent literature for foot operated devices for lifting toilet seats. U.S. Pat. No. 4,975,988 to Woo discloses a seat lifting device which opens the seat by depression of a foot pedal and locks the seat in the upright position. The locking mechanism is released by releasing a second catch in order to lower the seat. The problem with this construction is that, after the catch is released, there is no control over the speed with which the seat returns to the horizontal position.

U.S. Pat. No. 5,103,506 to Munford et al is for a foot operated linkage installed on the floor of the toilet area for raising and lowering the seat. The device occupies substantially more space than the instant invention and has no means for locking the seat in position.

U.S. Pat. No. 4,951,324 to Lirette is for a toilet seat lifter having a "handle bar" design which is partially operated by the hand.

Other lifting devices such as frequently seen on garbage containers are operated by stepping on a pedal which maintains the lid in an open position as long as the pedal is depressed but which closes as soon as the foot is removed from the pedal. This arrangement is obviously unsatisfactory for toilet seats and is even inconvenient for situations where it is desirable to keep the lid open for a time after removing the foot from the pedal.

THE INVENTION

OBJECTS

It is an object of this invention to open a hinged member such as lifting a toilet seat and closing the hinged member by operation of the foot on a pedal.

It is another object that the hinged member remain locked in the open position until released by depression of the pedal.

It is another object that the operation be performed without a requirement to use the hands.

SUMMARY:

This invention is directed toward a device including a foot operated lever that turns a gear assembly coupled to a toilet seat so as to raise the toilet seat from a horizontal position to a substantially vertical position. A ratchet lock assembly locks the toilet seat in the vertical position. A second depression of the pedal releases the ratchet lock assembly and permits the hinged member to rotate back to the horizontal position at a speed controlled by the user's foot on the pedal.

The ratchet lock assembly includes a ratchet wheel that is ratcheted to the lever to turn in the direction from horizontal to vertical position when the pedal is depressed but is released from the lever when the lever rotates in a direction from the vertical position back toward the horizontal direction. When the seat is raised, a catch on the ratchet wheel engages a detent in a stationary base of the device and one of the members of the gear assembly thereby locking the gear and seat. When the pedal is stepped on a second time, the catch is withdrawn permitting the seat to descend to the horizontal position. While the features of the invention are described in connection with its use on a toilet, it will be understood that the device is adaptable to other applications and situations as described herein.

DRAWINGS

FIG. 1 is an assembly view of the foot actuated double acting lever mounted on a toilet bowl.

FIG. 2 A, 2B and 2C are mechanical schematic diagrams illustrating principles of the invention.

FIG. 5 A shows details of the ratchet wheel assembly.

Figure 5B:
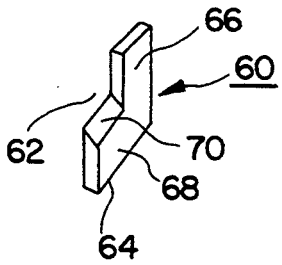

FIG. 5B shows details of the ratchet catch.

Figure 6A:
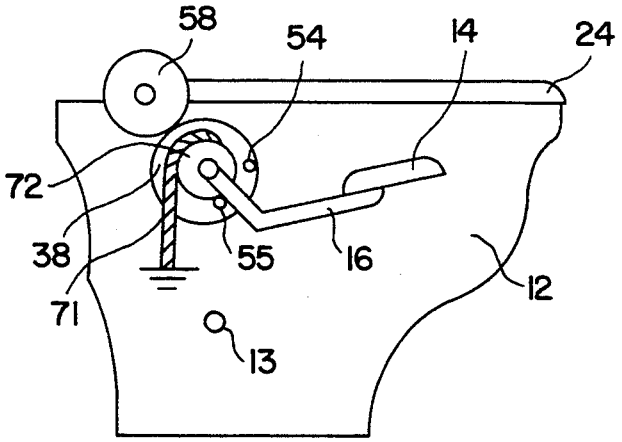

FIG. 6A shows one arrangement for applying spring bias for lever return.

FIG. 6 B shows another arrangement for applying spring bias for lever return.

Figures 7A, 7B:
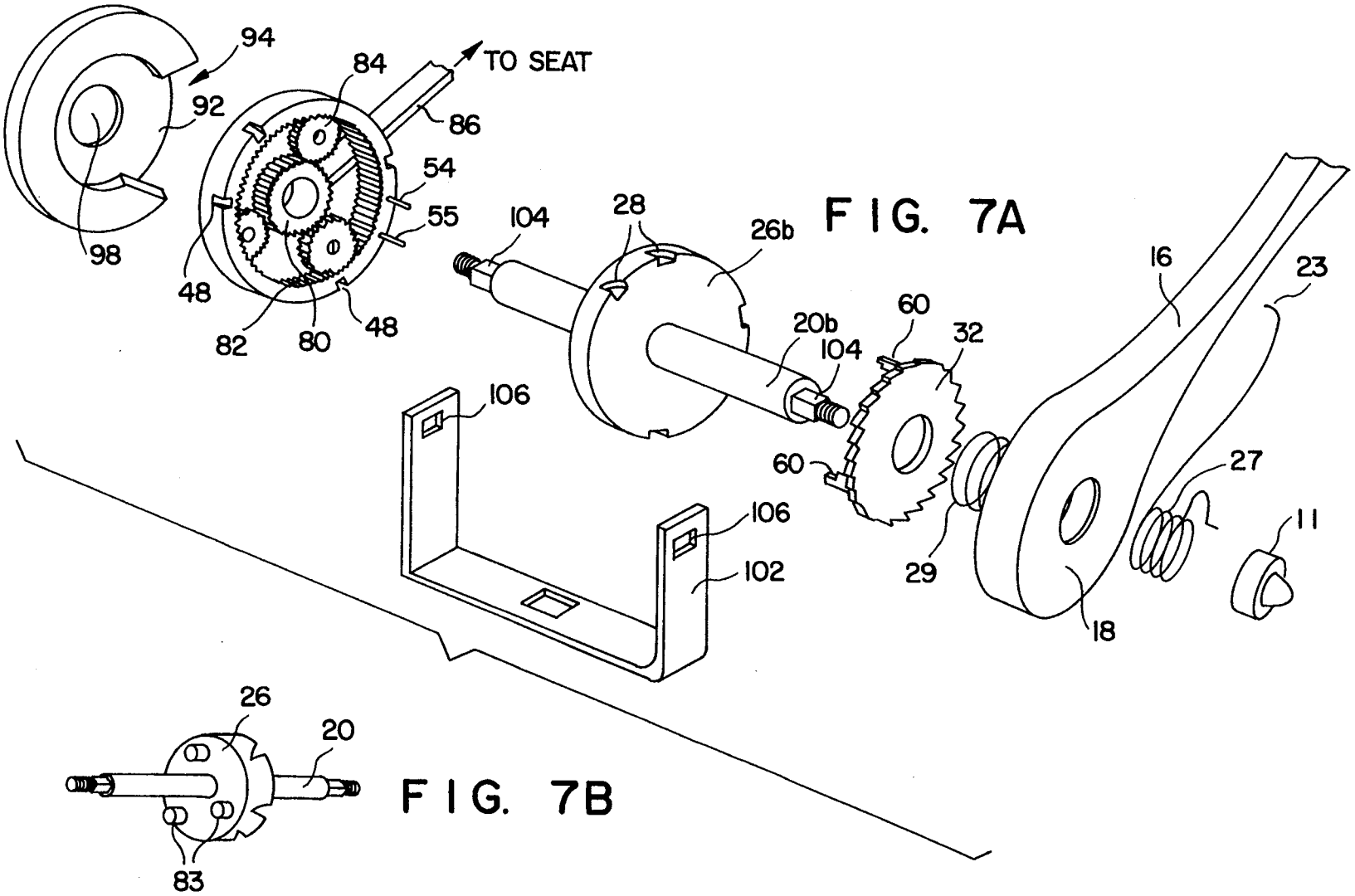

FIG. 7A is an exploded view of a second ratchet lock assembly featuring only one axis of rotation.

FIG. 7B shows details of the stool member of FIG. 7A.

Figure 7C:
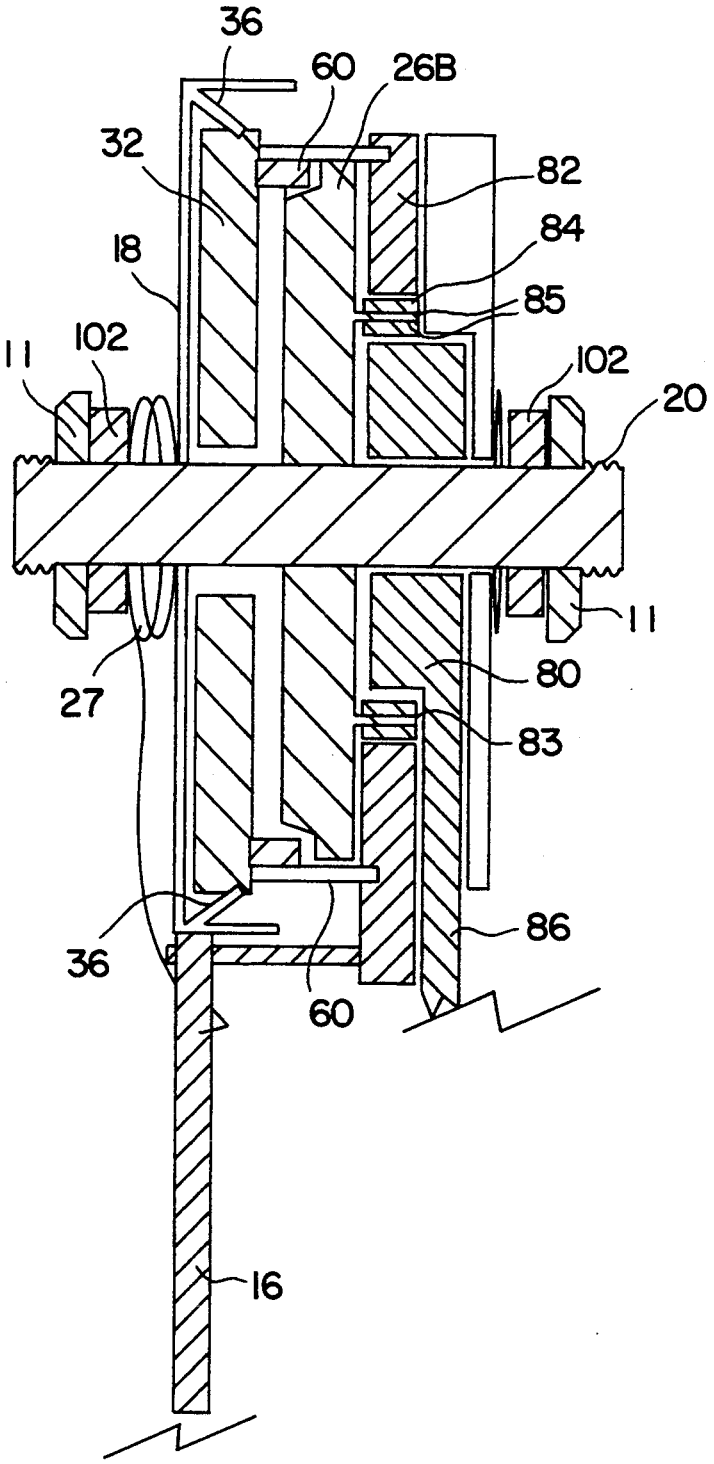

FIG. 7C is a sectional view of the assembly of FIG. 7A.

Figure 8:
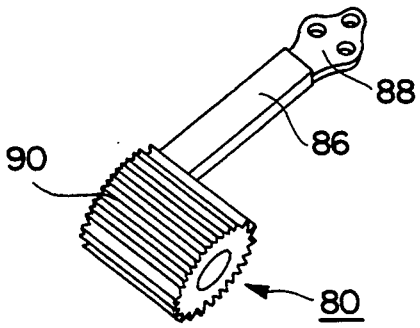

FIG. 8 shows details of the hinge gear used in the construction of FIG. 7.

Figure 9:
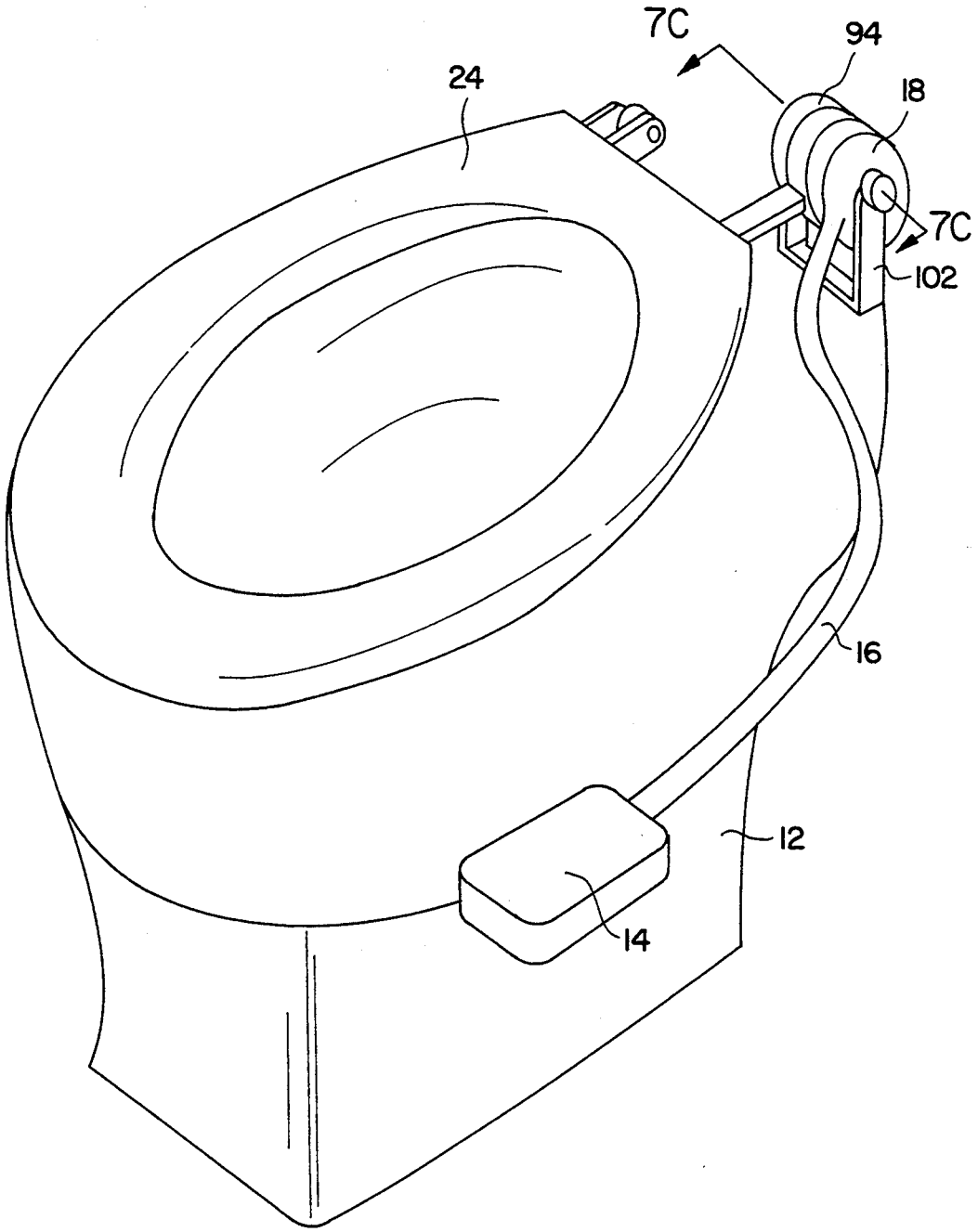

FIG. 9 is an exploded view of an embodiment having one axle.

FIGS. 10 A–E show relative positions of the locking mechanism, lever and toilet seat.

Figure 11A:
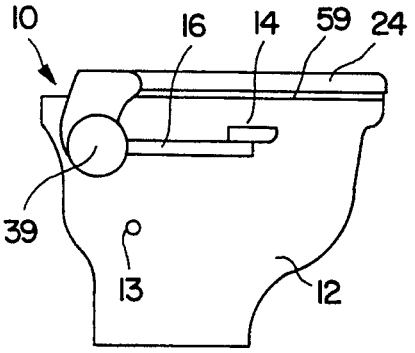

FIGS. 11 A and B show the hinge located below the top edge of the toilet bowl.

Figure 12:
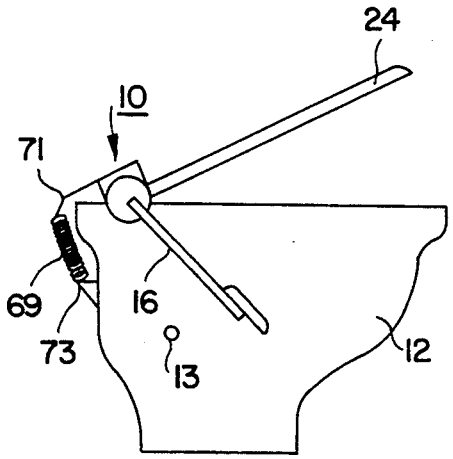

FIG. 12 shows an additional spring bias to prevent slamming of the toilet seat.

Figure 13:
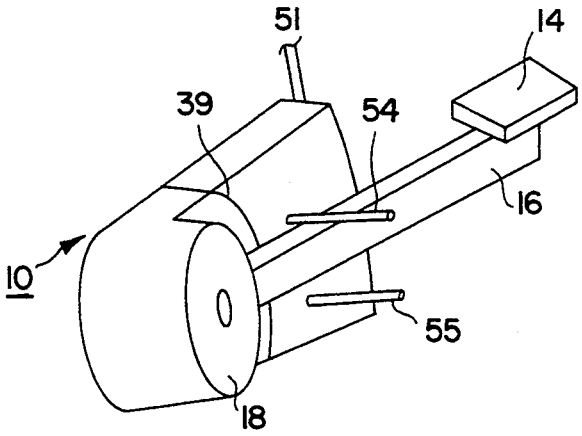

FIG. 13 shows the lever-locking mechanism of this invention used to position a cable.

DESCRIPTION OF A PREFERRED EMBODIMENT

Figure 1:
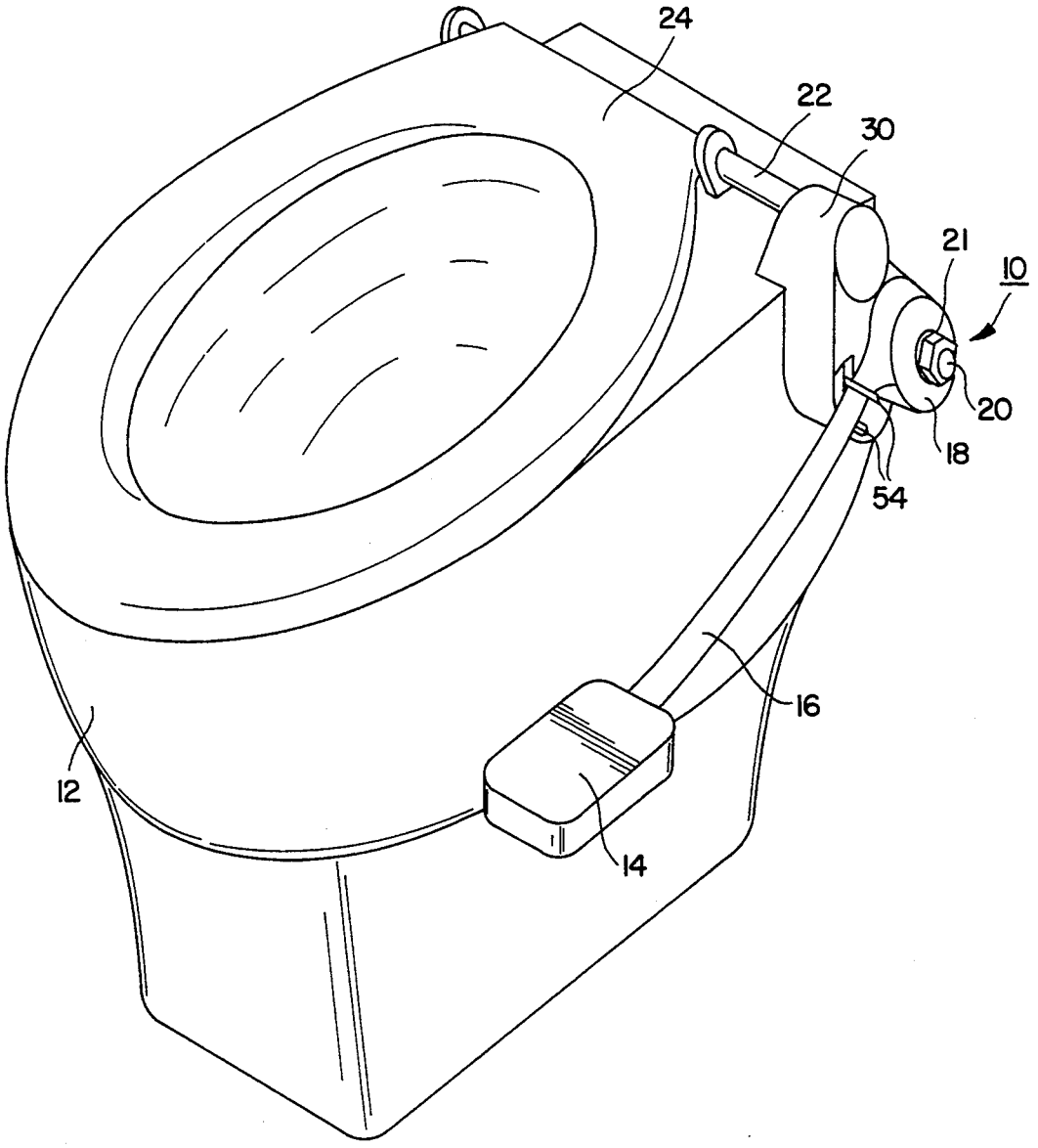

Turning now to a discussion of the drawings, FIG. 1 is a view of the foot actuated double acting lever assembly 10 of this invention mounted on a toilet bowl 12. The way in which interaction of the parts of the assembly can be best understood is to first understand what the assembly is intended to accomplish.

Figure 2A:
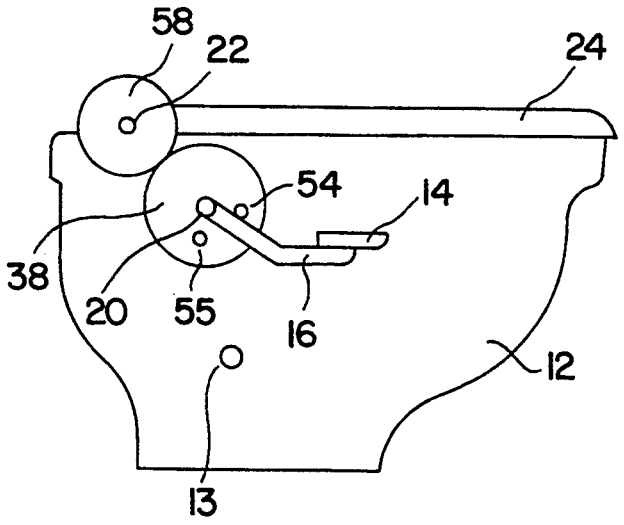
Figure 2B:
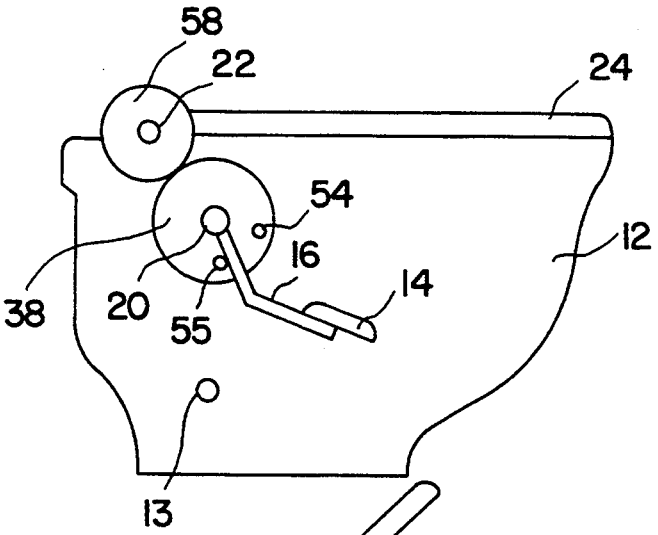
Figure 2C:
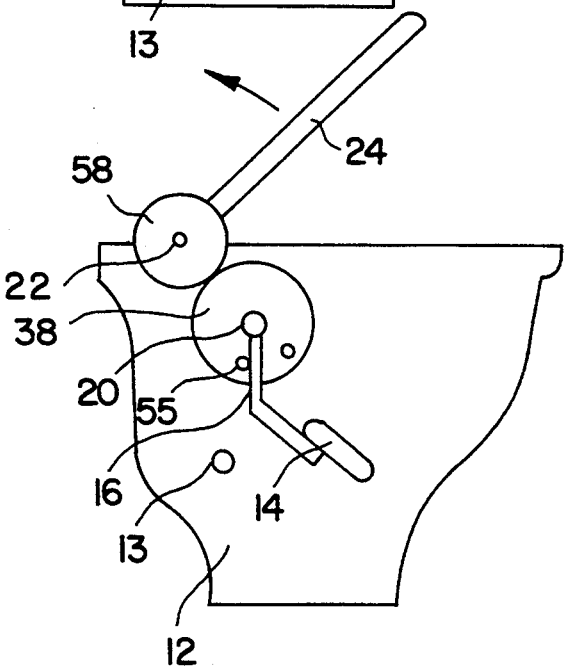

Steps in the operation of the device are most easily described with reference to the mechanical schematic of FIGS. 2A, 2B and 2C which illustrate a drive gear 38 rotatably mounted on a toilet bowl 12 and engaging a hinge gear 58. Hinge gear 58 is securely mounted on hinge pin 22 so that when the hinge gear 58 is forced to turn by drive gear 38, the toilet seat 24 is lifted to an upright orientation. The toilet seat 24 is hingably attached to the toilet bowl 12 through hinge pin 22. One end of a lever 16 is mounted on the same shaft 20 as drive gear 38 and can rotate independently of drive gear 38 within limits that are established by studs 54 and 55. When no force is applied by the users foot (not shown) to pedal 14, the lever 16 is biased by a spring (not shown in FIG. 2 ) to rotate against stud 54 as shown in FIG. 2 A. As the pedal 14 is partially depressed as shown in fig.2B, the lever 16 moves from contact with stud 54 toward contact with stud 55 and as the user continues to press the pedal 14, as shown in FIG. 2C, the lever 16 will now turn the drive gear 38 and the seat 24 is raised until the locking mechanism locks the seat in the raised position. Simultaneously with the locking action, stop 13 shown in FIG. 2A, B and C, prevent further rotation of the lever in the clockwise direction. When the user removes his foot from the pedal 38, the spring bias forces the lever 16 back against stud 54. When the user depresses the pedal 14 a second time applying enough force to release the locking mechanism, gravity forces the seat to turn clockwise so the lever contacts stud 55 and the seat returns to the horizontal position at a speed that is controlled by the foot against the pedal.

Figures 3A, 3B:
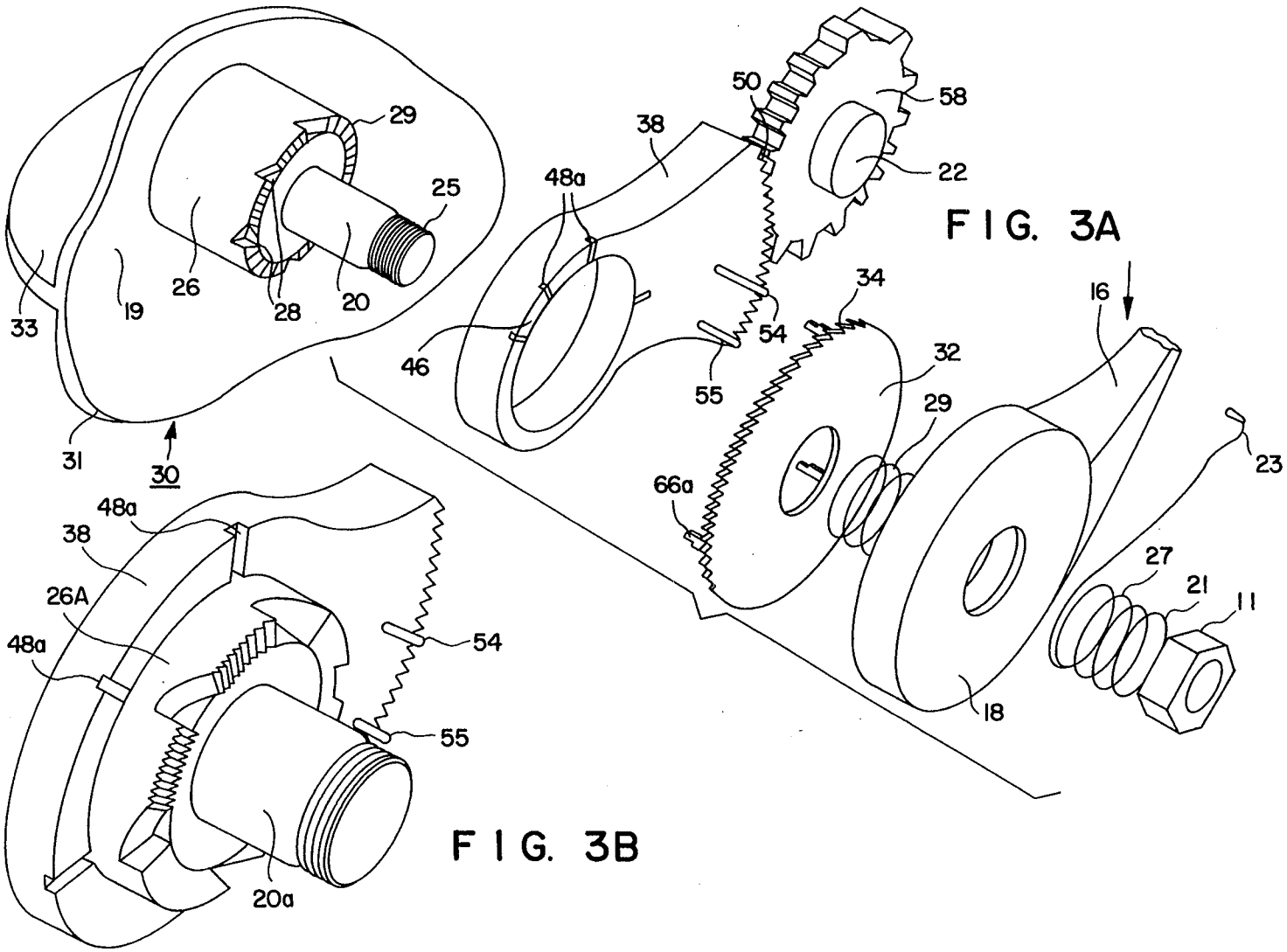
FIG. 3A is an exploded view of the locking ratchet assembly.
FIG. 3B shows details of the stool and drive gear mechanism.

Details of the ratcheting lock mechanism in combination with the lever 16, drive gear 38 and hinge gear 58 are illustrated in the assembly view of FIG. 1 and the exploded view FIG. 3. The lever assembly includes a foot pedal 14 on the free end of lever 16 whose other end is attached to a rotatable housing 18. Rotatable housing 18 is mounted on a main shaft 20A (nonrotating) where it is retained by nut 11 threaded onto the end of shaft 20A. Shaft 20A is shown with threaded end 25 for engagement with nut 11 and an opposite end mounted on stool 26A. Stool 26A has a series of detent notches 28 distributed mound its edge. Stool 26A also has teeth 29 distributed around its edge. Details of the drive gear 38 mounted on stool 26A are also shown magnified for more convenient examination in FIG. 3 B. Stool 26A is secured to mounting flange 30 attachable to the toilet bowl 12. Portions of mounting flange 30 are cutaway in FIG. 3. A ratchet wheel 32 is also rotatably mounted on shaft 20A. Notches 48A engage catches 66 A as described in connection with the discussion of FIGS. 10A–E.

Figure 4:
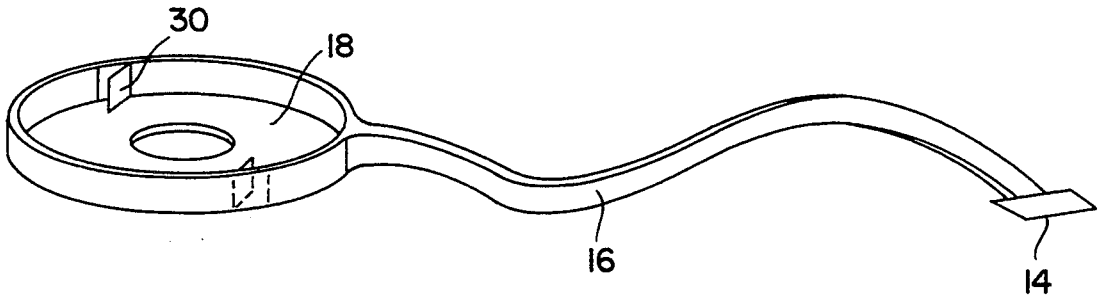
FIG. 4 shows details of the rotatable housing attached to the lever.

FIG. 4 shows spring catches 36, attached to the inside of rotatable housing 18 and are biased to engage the teeth 34 of ratchet gear 32 when the rotatable housing 18 is rotated in the clockwise direction by depression of the pedal 14 but which slide over the ratchet teeth when the rotatable housing is turned in the opposite direction.

FIG. 3 also shows a drive gear 38 that is rotatably mounted on stool 26A. Drive gear 38 engages hinge gear 58 which is securely mounted on hinge pin 22 that is attached to and rotates with the toilet seat 24. FIG. 3 shows studs 54 and 55 secured in drive gear 38. As shown in FIG. 1 and discussed in connection with the description of FIG. 2, lever 16 is positioned between these two studs. When the pedal 14 is not depressed, the lever 16 is in the rest position shown in FIG. 2A, and maintained in this position by spring 27. Spring 27 has one end 23 engaging the lever 16 and a second end 21 secured to the fixed shaft 20A. Spring 29 and 27 force the locking ratchet 32 toward the drive gear 38.

Figure 5A:
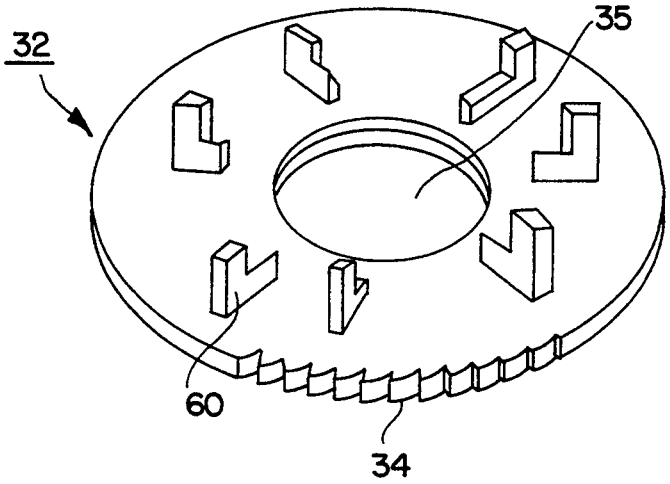

Details of the ratchet wheel 32 are shown in FIG. 5. Ratchet wheel 32 is a round plate with teeth 34 on its outside edge and a central hole 35 for slidably mounting on shaft 20A. At least one lock catch 60 (several are shown in FIG. 5A) is mounted on the ratchet wheel 32. Details of the lock catch are shown in FIG. 5 B. Each lock catch 60 is a rectangular platelet with a square notch 62 cut in one corner. The platelet securely stands on the ratchet wheel 32 on one edge 64 such that one section 66 of the notched platelet 60 is longer than the other shorter section 68. The upper face 70 of the short edge 68 is bevelled. The bevelled face 70 of short section 68 engages either the detent notch 28 when the drive gear is locked or teeth 29 of stool 26 when it is desired to allow the ratchet wheel to turn in the clockwise direction but prevents the ratchet wheel from turning in the counter clockwise direction.

The interactions of the slots in the drive gear, (he detent notches in the stool and the lock catch as a function of the position of the lever, drive drive gear and seat are illustrated in the mechanical schematic diagrams of FIGS. 10 A–E corresponding to the position of the seat 24 on bowl 12 and studs 54 and 55, and stop 13. The features in each of FIG. 10 B–E correspond to the features in FIG. 10A and the features of FIG. 10 A are numbered in accordance with the numbers in the other FIGS. 10 B–E.

In FIG. 10 A, the seat 24 is in the horizontal position and the lever 16 is not depressed so that lever 16 is against stud 54 on drive gear 38. Slot 48 is clockwise (fight in the FIG. 10 A) of the lock catch 66–68 and lock catch 66–68 is clockwise of detent notch 28. The ratchet wheel always turns clockwise when the rotatable housing 18 with lever 16 turns clockwise as shown in fig. A, B, C and D and always remains stationary when the rotatable housing 18 with lever 16 turns counterclockwise as shown in E.

When the pedal is depressed from the position shown in FIG. 10 A to the position shown in FIG. 10 B where lever 16 is against stud 55, slot 48 in drive gear 38 remains stationary and lock catch 66–68 moves clockwise into alignment with slot 48. (position of gear 38 is unchanged during this first movement of lock catch 66–68 because the lever 16 is not forcing either stud 55 or 54.)

When the lever is pressed further, the features change from positions shown in FIG. 10 B to FIG. 10 C where the lever has been turned to contact with stop 13, seat 24 is raised, lock catch 66–68 and slot 48 move into alignment with detent notch 28+ permitting short section 68 to engage with fixed notch detent 28+ and long section 66 to engage with slot 48 on drive gear 38 thereby locking drive gear 38 and seat 24 in the raised position. The seat will remain in the raised position after the lever 16 is released and returns against stud 54 as shown in FIG. 10 CC.

When the lever 16 is again depressed so that it moves to the position shown in FIG. 10D, the lock catch 66–68 detent moves out of engagement with the slot 48 and detent notch 28+ because of the camming action of the tapered bottom of the detent notch acting on the lock catch. Gravity will return the seat toward the horizontal position as shown in FIG. 10 E and the drive gear thereby turns in the counterclockwise direction so that the slot 48 moves back to the position shown in FIG. 10 A and relative to detent notch 28 and the next lock catch 68- and 66-.

Referring to FIGS. 1 and 3, design of mounting flange 30 depends on the construction of the toilet bowl 12 but will be understood in many situations to include a vertical member 31 to which the stool 26 is secured and secured to a horizontal member 33 which overlies the top of the toilet bowl. Portions of the mounting flange 30 in FIG. 3 have been cutaway in order to display details of the ratchet lock assembly. The mounting flange 30 shown in FIG. 1 is shown with a cover which prevents inadvertent contact with the gears of the invention. Any of the constructions of the mounting flange 30 selected to accommodate the design of the toilet bowl are embodiments of the invention.

Variations in other pans of the construction are also adaptable which are within the scope of the invention.

Figure 11B:
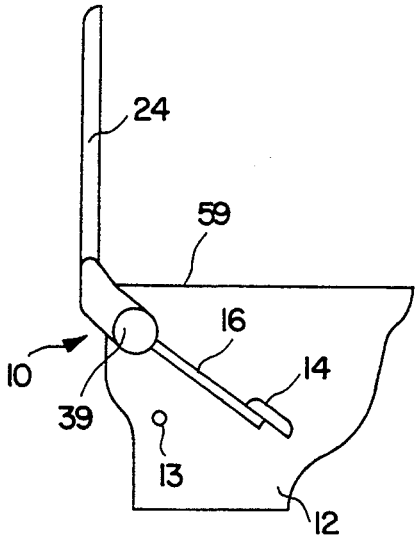

For example, FIG. 11 A shows a seat 24 hinged to a toilet bowl where the axis of rotation 19 is positioned below the level of the seat at a location such that, as shown in FIG. 11B, the seat in the raised position is lifted away from the center of the toilet to provide greater convenience when the toilet is used with the seat in the raised position.

Figure 6B:
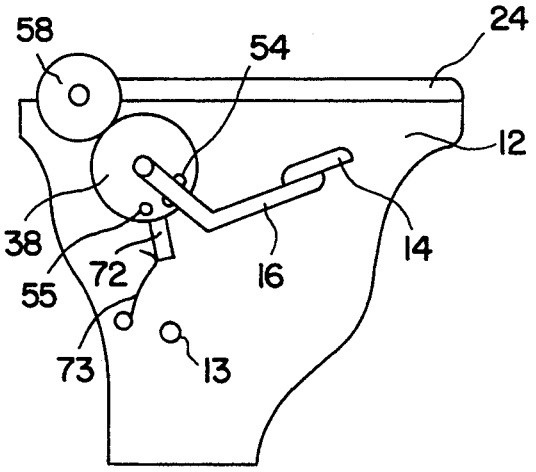

FIG. 6 A and B show arrangements for applying spring bias to the lever to restore the seat to the horizontal position when the seat has oriented beyond the vertical position. Bias is achieved by a spring 71 coupled to the drive gear 38. In FIG. 6A the spring is simply a coil spring having one end attached, to the toilet bowl and the other end attached to a shoulder 72. In FIG. 6B the spring is a flat spring 73 with one end attached to the toilet bowl 12 and the other end contacting the arm 72 which is attached to the drive gear 38.

Another embodiment of the invention is shown in the assembly view FIG. 9 and the exploded view FIG. 7A. which is configured with only one axle for supporting both the rotatable housing 18 attached to the lever 16, the drive gear 82, the ratchet wheel 32 and the hinge gear 80 coupled to the toilet seat 24. (The toilet seat 24 is not shown in FIG. 7A). The drive gear 82 is an internal gear engaging the hinge gear 80 through a plurality of planetary gears 84. Three planetary gears 84 are shown in FIG. 7A. FIG. 7C shows a sectional view of the embodiment of FIG. 7A and 9.

Details of the hinge gear member 80 are shown in FIG. 8 which shows an extension 86 with one end 88 configured for bolting to the toilet seat and the other end extending from the gear 90. The internal drive gear 82 is shown in FIG. 7A with slots 28 and studs 54 and 55 as discussed in the description of FIG. 3. A washer housing 94 fits around the outside of drive gear 82. Washer housing 94 has a cutout 92 in its outer wall to permit arm 86 from hinge gear 80 to extend out for connection to the toilet seat 24. The hinging gear 80 is rotatably mounted on shaft 20B. An immobile disk 26B with notches 28 and mounted onto shaft 20B performs the same function in FIG. 7A–C as the stool 26A on shaft 20A shown in FIG. 3 and discussed above. The rotatable housing 8, ratchet wheel 32, load spring 29, biasing spring drive gear and hinge gear assembly (80, 82), and washer housing 94 are all slidably mounted onto shaft 20B in the order shown in the exploded drawing of FIG. 7A. Shaft 20B is mounted on yoke 102 and prevented from turning by square ends 104 through apertures 106 on each end of the yoke 102. The planetary gears 84 are mounted on studs 83 shown in FIG. 7B. The entire assembly is further secured by nut 11 and another nut not shown) screwed onto the end of shaft 20B.

The yoke 102 is secured to the top surface of the toilet bowl as shown in FIG. 9.

FIG. 12 shows a variation in which an additional biasing spring 69 has one end attached to the rear end of the toilet seat 24 and another end 73 attached to the bowl 12 with the spring biased so that the seat will not be allowed inadvertently to slam down on the bowl.

In the foregoing paragraphs, embodiments have been described which meet the objects of the invention. A major feature is a lever and gear coupled to the toilet seat which are locked when a pedal is not depressed but which are unlocked for raising and lowering the seat when the pedal is depressed. Other variations and uses are suggested by the drawings and description which are within the scope of the invention.

For example, FIG. 13 shows a device 17 incorporating the principals of the invention to pull and lock in position a cable 51. In FIG. 13, a rotating member 39 and cable 51 have replaced the toilet seat so that depressing pedal 14 pulls the cable from a first position to a second position where it is locked and then depressing the pedal a second time releases the locking mechanism 10 and enables the rotating member 39 with cable 51 to return to its first position. Another application could be to apply force to a push rod in place of the cable shown in FIG. 13.

In another example, the principles of the invention may be applied to a lid on a container where it is required to leave the hands unencumbered. Furthermore, the locking ratchet principle could be applied to locking a vertical door (or lid) in an open position by orientating the axis of the drive gear, hinge gear and lever in the vertical orientation for operation with the hand. Therefore the terms "lid" and "lid member" are taken in the context of this application to include a door, lid or toilet seat or rotating member such as discussed with reference to FIG. 13 which is hingably attached to a base which is understood to mean, for example, toilets with toilet seats, freezers with hinged lids, garbage containers with lids, doors mounted by hinges to a door frame, and the like.

In view of the numerous situations and various construction to which the principals of the invention may be applied, I therefore wish to define the scope of my invention by the appended claims and in view of the specification if need be.

I claim:

1. A device for orienting a lid member by a user from a first position to a second position and locking said lid member in said second position, said lid member adapted to be secured to a hinge adapted to be mounted on a base to rotate about a hinge axis, which device comprises:

a lever having a first end and having a second end adapted for being rotatably mounted on said base;

a hinge gear member adapted to be rotatably mounted about said hinge axis anti adapted to be securely coupled to said lid member;

a shaft member adapted for mounting on said base;

a drive gear member rotatably mounted on said shaft member and engaged with said hinge gear member;

a means for coupling said drive gear to said second end of said lever;

a ratchet means for operatively connected to said second end of said lever for locking said lid member in said second position when said first end is depressed and released by said user and unlocking and reorienting said lid member to said first position when said user again depresses and releases said first end.

2. A device as in claim 1 wherein said means for coupling said drive gear to said lever comprises a pair of studs secured in said drive gear and separated from one another by a space with said lever positioned in said space.

3. A device as in claim 1 which comprises:

said hinge gear member and said drive gear member both being mounted on said shaft member;

said drive gear member being an internal gear enclosing said hinge gear;

a plurality of planetary gears engaging said drive gear member and said hinge gear member, each one of said plurality of planetary gears being rotatably mounted on a stool member said stool member adapted to be secured to said base.

4. A device as in claim 1 wherein said base is a toilet bowl and said lid is a toilet seat.

5. A device as in claim 4 which comprises a spring bias means having one end adapted to be secured to said toilet bowl and another end adapted to be secured to said toilet seat for restraining said toilet seat while said toilet seat is returning from said second position to said first position.

6. A device as in claim 2 wherein said base is a container and said lid member is a lid for said container.

7. A device as in claim 1 wherein said shaft member is horizontal.

8. A device for orienting a lid member by a user from a first position to a second position and locking said lid member in said second position, said lid member adapted to be secured to a hinge adapted to be mounted on a base to rotate about a hinge axis, which device comprises:

a lever having a first end and having a second end adapted for being rotatably mounted on said base;

means on said second end of said lever adapted for coupling said lever to the lid member and orienting the lid member to said second position when said first end is depressed by said user;

said means for coupling includes a rotatable housing member secured to said second end of said lever and rotatably mounted on said shaft member; said means for coupling further including a drive gear member rotatably mounted on said shaft member and within said housing member and adapted to engage said hinge gear member;

a ratchet wheel having an outer perimeter and rotatably and slidably mounted on said shaft;

means for engaging said ratchet wheel with said rotatable housing such that said ratchet wheel rotates in a first direction when said rotatable housing turns in a first direction but remains stationary when said rotatable housing is rotated in a second direction;

means for locking said ratchet wheel to said base and to said drive gear member when said lid member is in said second position and said lever is first end of said depressed and released and unlocking said ratchet wheel from said base and said drug gear when said first end of said lever is again depressed and released, allowing said lid member to move from said second position to said first position.

9. A device as in claim 8 wherein said ratchet wheel has teeth on said perimeter and said means for engaging said ratchet wheel with said rotatable housing is a spring catch secured to said rotatable housing and said spring catch is biased to engage said teeth and turn said ratchet wheel when said lever secured to said rotatable housing is turned in a direction from said first position toward said second position and said spring catch is adapted to slide over said teeth when said lever rotates in a direction from said second position to said first position.

10. A device as in claim 8 wherein said means for locking said ratchet wheel to said base and said drive gear comprises:

said drive gear member having a plurality of slots;

a stool member adapted to be secured to said base having a plurality of detent notches;

a plurality of lock catches secured to said ratchet wheel; said catches operatively aligned with said detent notches and said slots when said lid is in said second orientation, such that a first section of one of said lock catches is engaged with one of said slots and a second section of one of said lock catches is engaged with one of said detent notches;

each of said second sections of said lock catch having a shape and each of said detent notches having a shape that is cammed with said lock catch shape such that, when said lock catch is engaged with said notch, said lid is positioned in said second position, and said second section of said lock catch is forced from said detent notch enabling said lid member coupled to said lever and said drive gear to turn in a direction from said second position toward said first position while said ratchet wheel is stationary.

11. A device as in claim 10 which comprises a spring means coaxially on said shaft and positioned between said ratchet wheel and said rotatable housing for forcing said ratchet wheel toward said drive gear member.

12. A device as in claim 10 which comprises spring bias means for biasing said lever member to rotate in a direction from said second position toward said first position.

13. A device as in claim 12 wherein said spring biasing means is a coil spring mounted coaxially on said shaft and having one end secured to said shaft and another end secured to said lever member.

14. A device as in claim 12 wherein said spring biasing means is a coil spring having one end adapted to be secured to said base and another end adapted to be secured to said rotatable housing such that when said rotatable housing is rotated in said first direction, said coil spring biases said lever to turn in said second direction.

15. A device for orienting a toilet seat by a user from a first position to a second position and locking said toilet seat in said second position, said toilet seat, rotatably secured to a hinge mounted on a toilet bowl having an upper edge, said hinge having a hinge axis, below said upper edge, which device comprises:

a lever having a first end and having a second end adapted for being rotatably mounted on a toilet bowl;

means on said second end adapted for coupling said lever to the toilet seat and orienting the toilet seat to said second position when said first end is depressed by said user;

a ratchet means operatively connected to said second end of said lever for locking said toilet seat in said second position when said first end is released by said user and unlocking and reorienting said toilet seat to said first position when said user again depresses and releases said first end.

* * * * *

UNITED STATES PATENT AND TRADEMARK OFFICE

CERTIFICATE OF CORRECTION

PATENT NO. : 5,444,877

DATED : Aug. 29, 1995

INVENTOR(S) : Jey Kumarasurier

It is certified that error appears in the above-indentified patent and that said Letters Patent is hereby corrected as shown below:

In col 2 line 23, after "the horizontal position." insert --In another embodiment, the foot pedal actuates a compound lever which maintains the seat in the raised position until the pedal is depressed a second time--.

Figure 14:
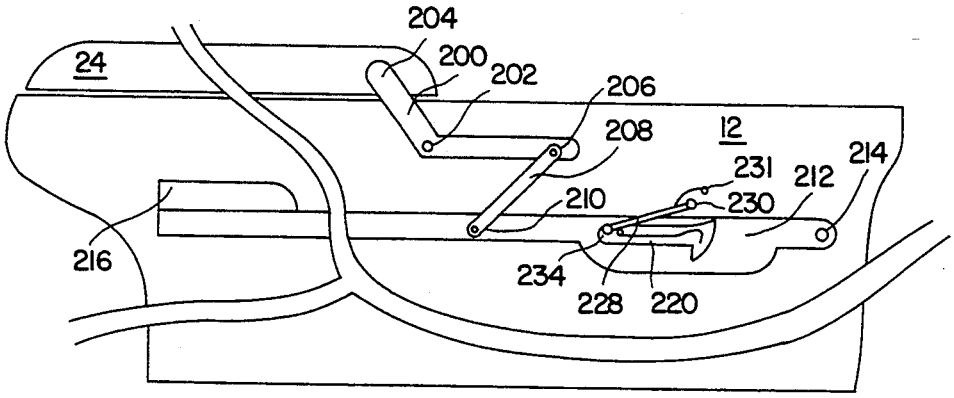
Figure 15:
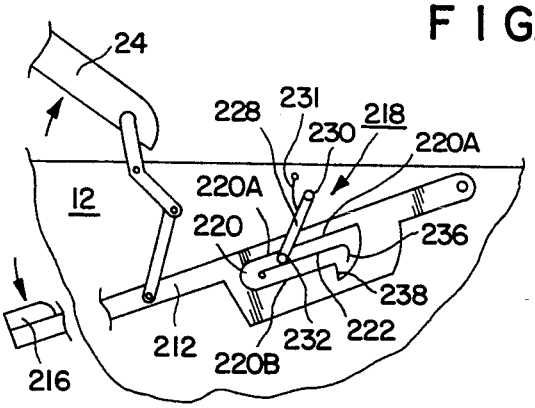
Figure 16:
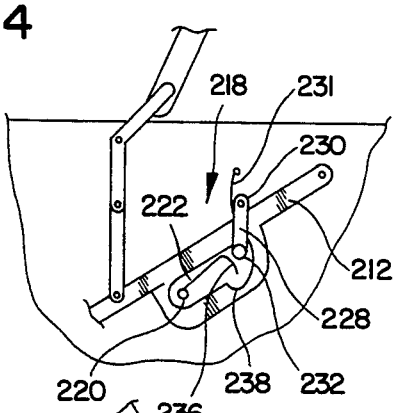

In col. 2 after line 63, insert --Fig. 14 is a cutaway side view of an embodiment having a slotted pedal lever with the seat horizontal.
Fig. 15 shows the seat of Fig. 14 being raised.
Fig. 16 shows the seat of Fig. 14 in the raised position.
Fig17shows the seat locked in the raised position.

Figure 18:
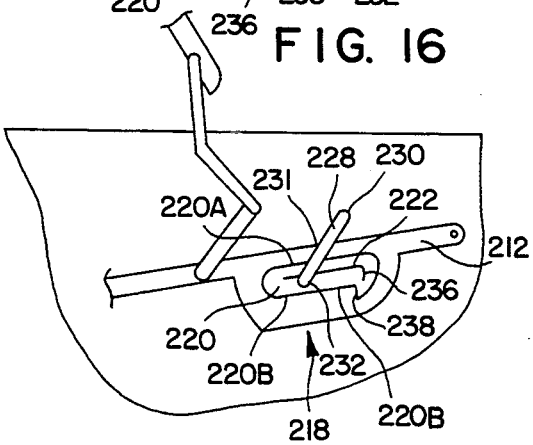

Fig. 18 shows the seat of Fig. 14 being lowered

Figure 19:
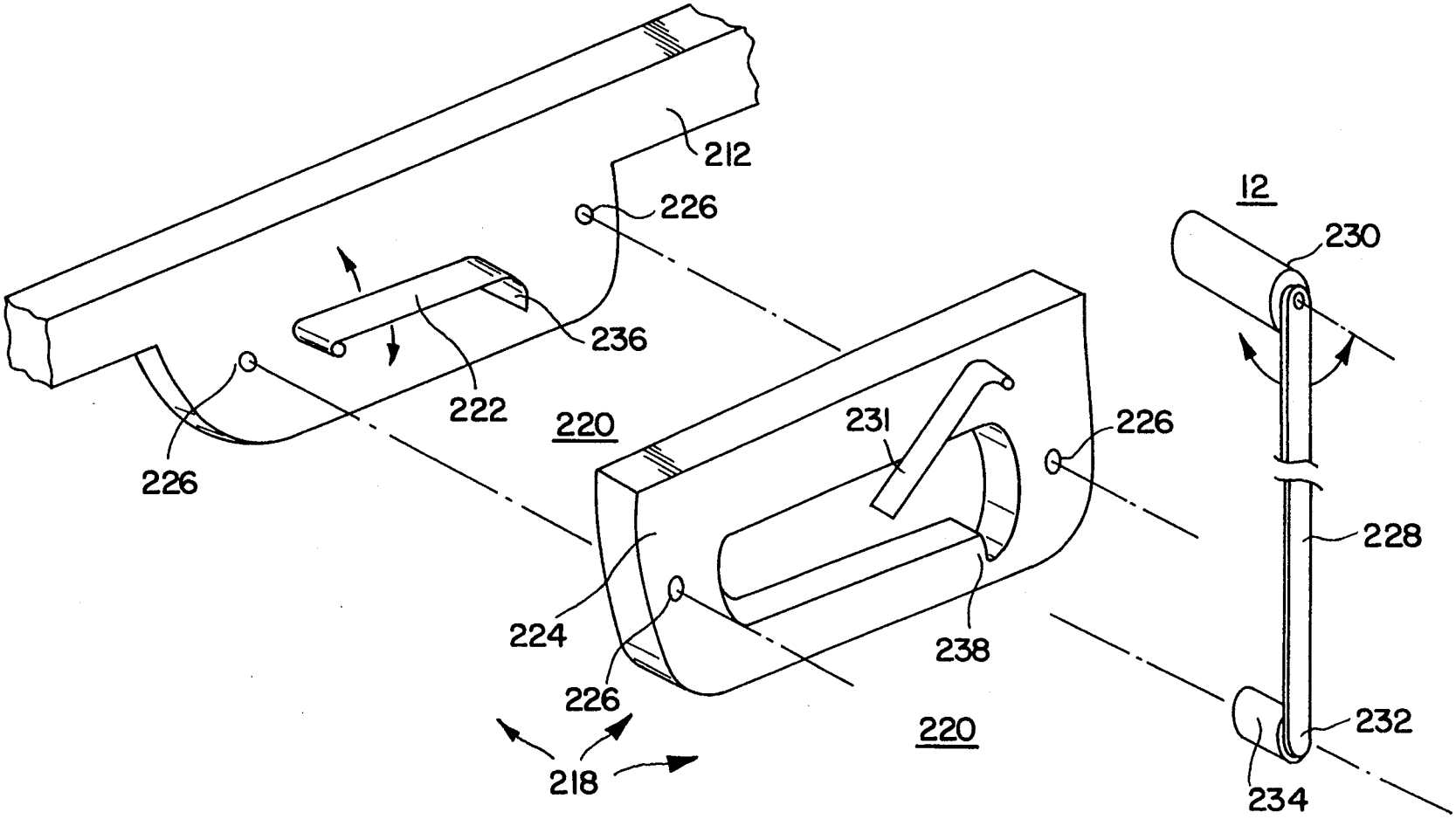
Figure 20:
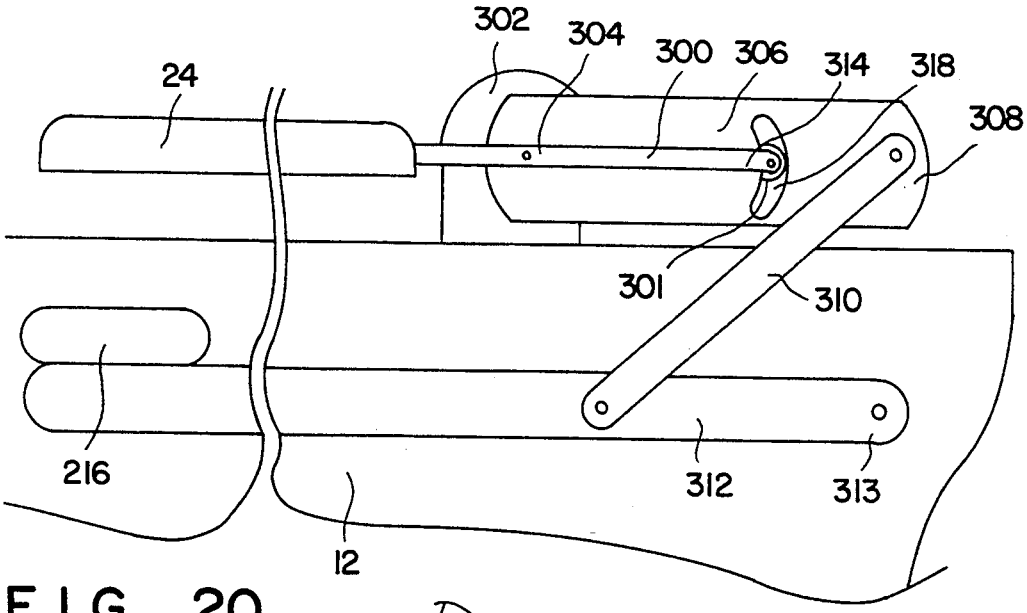
Figure 21:
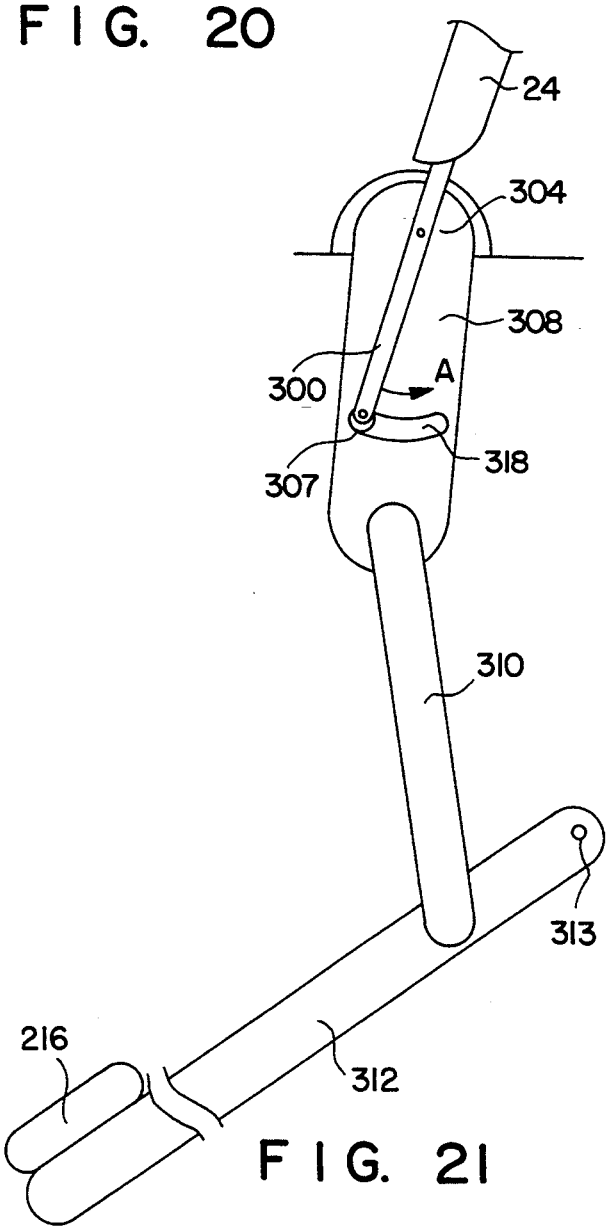
Figure 22:
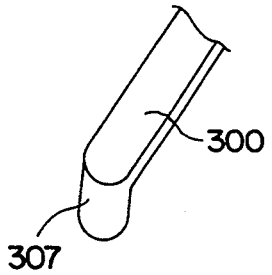
Figure 23:
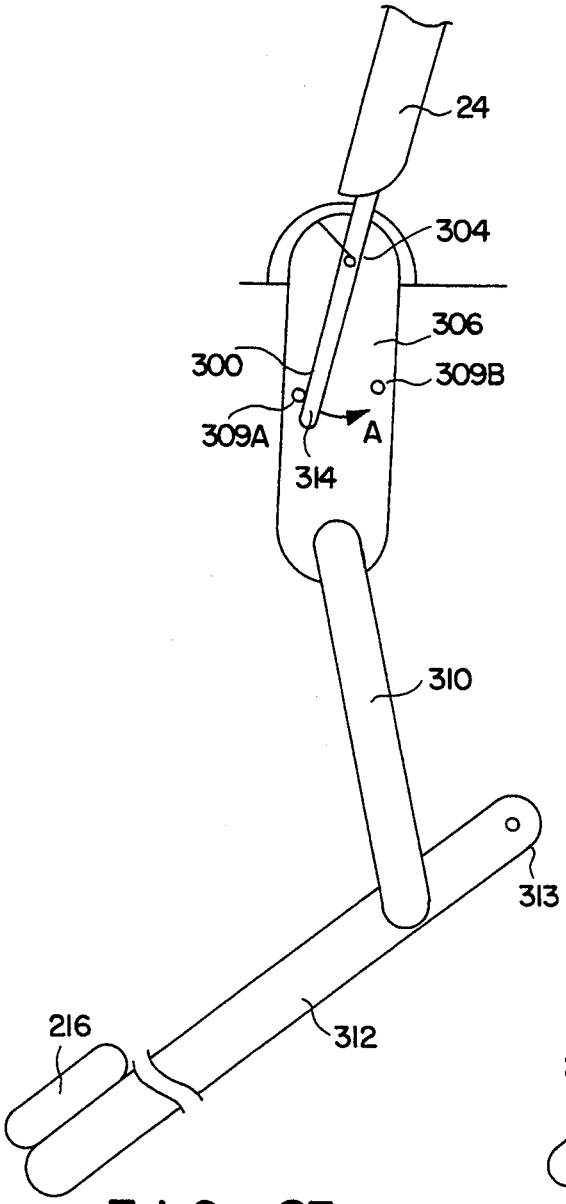
Figure 24:
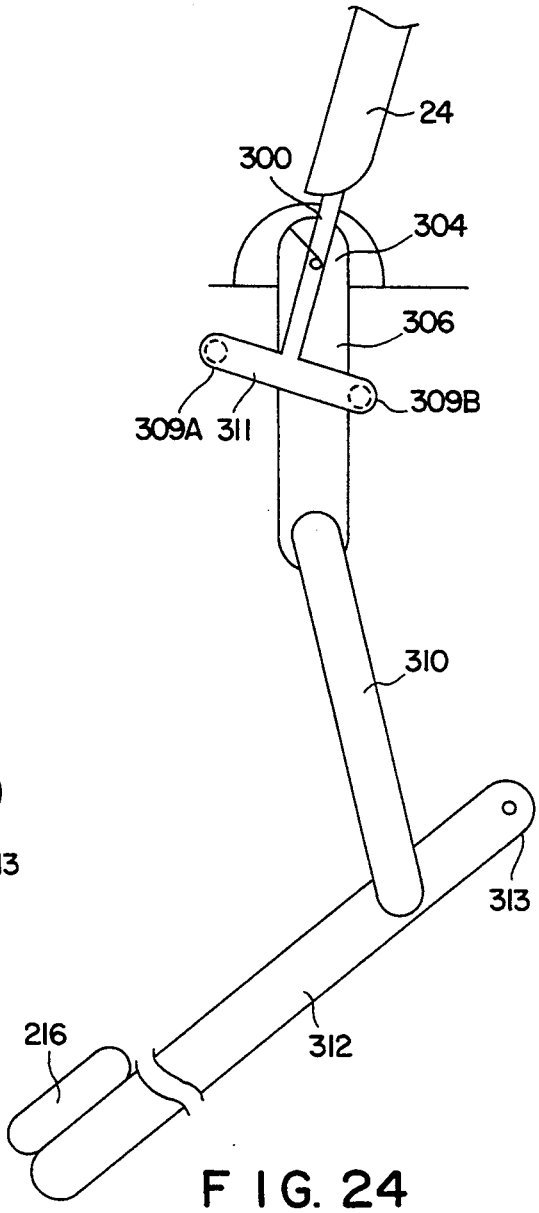

Fig. 19 shows details of the slotted pedal lever.
Fig. 20 shows a compound seat lever and horizontal seat.
Fig. 21 shows the seat of Fig. 20 in the horizontal position.
Fig. 22 shows details of a stud used in the embodiment of Fig 20.
Fig. 23 shows another version of the embodiment of Fig.20
Fig. 24 shows a third version of the embodiment of Fig. 20.--

In col. 6, after line 12:

--Fig. 14 another embodiment showing toilet bowl 12 with lid 24 (cutawy) rigidly attached to one end 204 of a lid lever 200.

LID LEVER 200 pivots about pivot axis 202 and has another end 206 hingably attached to one end of coupling bar 208. Foot lever 212 is hingably attached to the other end of coupling bar 208. Foot lever 212 pivots about axis 214 attached to the bowl 12. As shown in fig. 15, when pedal 216 on foot lever 212 is depresed, coupling bar 208 turns lid lever 200 thereby raising lid 12.
Figs. 15, 16, 17, 18 show the steps which locking mechanism execute to lock the seat in an upright position with a first

UNITED STATES PATENT AND TRADEMARK OFFICE

CERTIFICATE OF CORRECTION

PATENT NO. : 5,444,877

DATED : Aug. 29, 1995

INVENTOR(S) : Jey Kumarasurier

It is certified that error appears in the above-indentified patent and that said Letters Patent is hereby corrected as shown below:

depression of the pedal and then to return the seat to the horizontal position with a second depression of the pedal 216. An exploded view of the locking mechanism 218 is shown in fig. 19. Locking mechanism 218 includes a slot 220 in footlever 212 formed by plate 224 (fig. 19 ) with recess 220 bolted to footlever 212.
A leaf spring 222 is mounted on footlever 212 so that leaf spring is positioned on in plate 224 when plate 224 is bolted to lever arm 212 by fasteners through bolt holes 226. A keeper bar 228 has one end 230 rotatably mounted on bowl 12 and another end 232 with stud 234 free to slide in slot 220.

Figs. 14-24 show embodiments of a compound lever of this invention.

Figure 17:
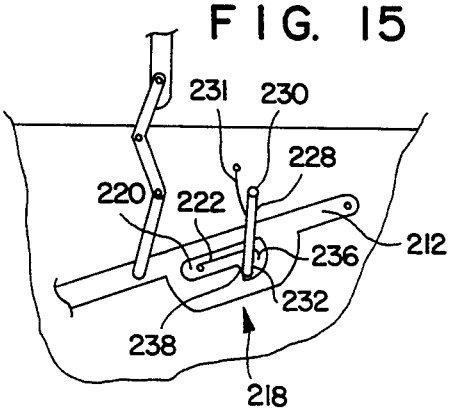

Fig. 14 shows the seat down and stud 234 in the leftmost position of slot 220. Fig. 15 shows that, as pedal 216 is depressed, spring 231 biases keeper bar 228 such that stud 234 is guided between the top side of spring 222 and the top side of recess 220. Fig. 16 shows that stud 234 is thereby directed to the upper most right hand corner of recess 220 as pedal 216 is fully depressed. When pedal 216 is released, hook 236 on the end of spring 222 directs stud 234 into the notch 238 of slot 222 as shown in fig. 17 so that the seat is retained in this position. When the pedal 216 is depressed a second time, stud 234 is directed by hook 238 and the bias of spring 231 to slide between the underside of spring 222 and the lower side of recess 220 (see fig. 18) back to "home" (fig. 14)

Fig. 20 and 21 show yet another mechanism for raising and lowering toilet seat 24 and temporarily locking seat 24 in the raised position. by two successive depressions of pedal 216. Fig. 20 shows the seat 24 in the horizontal positon and fig. 21 shows the seat 24 in the raised position. The seat 24 is rigidly attached to seat lever 300 which is mounted on bracket 302 to rotate about axis 304. Bracket 302 is mounted on bowl 12.

UNITED STATES PATENT AND TRADEMARK OFFICE

CERTIFICATE OF CORRECTION

PATENT NO. : 5,444,877

DATED : Aug. 29, 1995

INVENTOR(S) : Jey Kumarasurier

It is certified that error appears in the above-indentified patent and that said Letters Patent is hereby corrected as shown below:

Extension lever 306 also rotates on axis 304 about one end and has has another end 308 rotationally attached to and end of couple bar 310. The other end of couple bar 310 is rotationally attached to an end of couple bar 310.
pedal lever 312 which has an end pivotally secured to bowl 12.
A stud 307 on end 314 of seat lever 300 slides in slot 318.
Fig. 22 shows stud 307 on lever 300.
When pedal 216 is depressed (fig. 21) seat lever 300 rotating about axis 304, rotates to the vertical position and momentum of the moving seat carries the seat beyond vertical where it remains by virtue of slot 318. When pedal 216 is agin pressed to lower seat 24, couple bar 310 pulls lever 306 applying torque to seat lever 300 by virtue of 314 being constrained in slot 318. Seat 24 thereby falls back (see arrow A) to horizontal under control by foot pedal 216.

Figs. 23 and 24 show a compound lever construction wherein stops 309A and 309B define the range of angle between seat lever 300 and extension lever 306. Stops 309 A and B similarly to slot 318 engaging stud 307 (fig. 21).

UNITED STATES PATENT AND TRADEMARK OFFICE

CERTIFICATE OF CORRECTION

PATENT NO. : 5,444,877

DATED : Aug. 29, 1995

INVENTOR(S) : Jey Kumarasurier

It is certified that error appears in the above-indentified patent and that said Letters Patent is hereby corrected as shown below:

In fig. 23 stops 309A and B are mounted on extension lever 306 and limit the range of angle between seat lever 300 and extension lever 306. In fig. 24, stops A and B (shown in phantom) are mounted on cross arm 311 mounted on lever 300 and engage the sides of lever 306.--

Signed and Sealed this

Nineteenth Day of March, 1996

Bruce Lehman

*Attest:*

BRUCE LEHMAN

*Attesting Officer*

*Commissioner of Patents and Trademarks*